US010016809B2

(12) United States Patent
Saida

(10) Patent No.: US 10,016,809 B2
(45) Date of Patent: Jul. 10, 2018

(54) VACUUM DIE CASTING APPARATUS

(71) Applicant: DENSO CORPORATION, Kariya, Aichi-pref. (JP)

(72) Inventor: Takuma Saida, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/412,437

(22) Filed: Jan. 23, 2017

(65) Prior Publication Data

US 2017/0209920 A1 Jul. 27, 2017

(30) Foreign Application Priority Data

Jan. 22, 2016 (JP) ..... 2016-010491

(51) Int. Cl.
*B22D 17/08* (2006.01)
*B22D 17/14* (2006.01)

(52) U.S. Cl.
CPC ..... *B22D 17/145* (2013.01); *B22D 17/08* (2013.01)

(58) Field of Classification Search
CPC ..... B22D 17/08; B22D 17/14; B22D 17/145; B22D 17/2007
USPC ..... 164/253, 254, 303, 305
See application file for complete search history.

(56) References Cited

U.S. PATENT DOCUMENTS 6,615,902 B1 * 9/2003 Nishikawa et al. ... B22D 17/14 164/267
2002/0121355 A1 * 9/2002 Bigler et al. ..... B22D 18/04 164/113
2004/0089987 A1 5/2004 Kodama et al.

FOREIGN PATENT DOCUMENTS

JP S64-87051 A 3/1989
JP 2-199279 A * 8/1990 ..... F04B 41/06
JP 2007-268430 A 10/2007
JP 2015-166583 A 9/2015

* cited by examiner

*Primary Examiner* — Kevin P Kerns
(74) *Attorney, Agent, or Firm* — Oliff PLC

(57) ABSTRACT

A mold and cavity are coupled to a vacuum tank via a pressure reducing path. A first back-cleaning filter 4*a* is disposed between the cavity and the vacuum tank in the pressure reducing path. The vacuum tank and the second dry pump are series-connected via a mechanical booster pump. The vacuum tank is sucked by the mechanical booster pump and the second dry pump, thereby always maintaining a predetermined vacuum degree in the vacuum tank. When carrying out die casting, first, after the mold is closed, a release agent is applied on an inner peripheral surface of the mold. Next, while reducing a pressure in the cavity using the vacuum tank, a molten metal is injected to the cavity. When the molten metal is solidified, the mold is opened and a cast product is taken out from the mold.

4 Claims, 3 Drawing Sheets

VACUUM DIE CASTING APPARATUS

CROSS-REFERENCE TO RELATED APPLICATION

This application is based on and claims the benefit of priority from earlier Japanese Patent Application No. 2016-10491 filed on Jan. 22, 2016, the description of which is incorporated herein by reference.

TECHNICAL FIELD

This disclosure relates to a vacuum die casting apparatus carrying out casting in a state that a pressure of a cavity is reduced.

BACKGROUND

Recently, a vacuum die casting apparatus, which forms production by providing a molten metal such as aluminum (Al) to a mold, is widely used in a state that a pressure in a cavity is reduced by a vacuum pump. The cavity is formed surrounding the mold. A conventional technology with respect to the vacuum die casting is, for example, disclosed in Japanese Unexamined Patent Application Publication No. 64-87051. Die casting using the vacuum die casting apparatus allows the molten metal to flow well during injection and prevents defects due to air. Therefore, casting defects such as blowholes may be reduced.

For a die casting using the vacuum die casting apparatus, before injecting the molten metal, a powder release agent is applied to the inside surface of the cavity to release the cast product from the mold smoothly. Therefore, when gas in the cavity is sucked by the vacuum pump, there is a problem that the vacuum pump sucks residue of the powder release agent and the vacuum pump is damaged due to the residue. A mesh size of a filter which is disposed between the mold and the vacuum pump has been made small to improve the above-described problem. However, a new issue occurred that the filter became clogged quickly and production efficiency was decreased.

Therefore, in common vacuum die casting apparatuses in use, casting has been performed by using the vacuum pump having relatively low pressure reducing capacity without reducing the mesh size of the filter much. A vacuum pump having relatively low pressure reducing capacity is difficult to damage even if the powder release agent enters the pump. Therefore, in common vacuum die casting apparatuses, it was difficult to reduce the casting defects of the cast product and a vacuum degree in the cavity was not so high. Also, in common vacuum die casting apparatuses, it was difficult to improve productivity and it took time to reach the vacuum degree in the cavity to a target value.

SUMMARY

An embodiment provides a vacuum die casting apparatus that can improve quality of a cast product and the present disclosure has been made in view of such a background.

To solve the above-described issue, one aspect of this disclosure relates to a vacuum die casting apparatus which has a die casting machine, a pressure reducing unit and a filtration unit. The die casting machine has a mold including a cavity therein. The pressure reducing unit is coupled to the die casting machine via a pressure reducing path. The filtration unit is disposed between the die casting machine and the pressure reducing unit and is disposed on the pressure reducing path. Casting is performed by providing a molten metal to the cavity in a state that a pressure in the cavity is reduced. The filtration unit has filter housings and filter members. Each of the filter members is disposed in the respective filter housing through which gases sucked from the cavity pass. In addition, each of pressure tanks feeds gases to the filter member in a direction which is opposed to a direction through which the gases sucked from the cavity pass. Further, the filtration unit is formed by cleaning filters which clean the filter member. The pressure reducing unit includes a mechanical booster pump.

According to this structure, the pressure reducing unit includes the mechanical booster pump. Thereby, the vacuum degree in the cavity may be increased, and blowhole is reduced and quality of the cast product may be improved. In addition, the vacuum in the cavity may reach a target value quickly, productivity for a die casting may be improved. In addition, the filtration unit is formed by the cleaning filter which cleans the filter member. Thereby, even if a mesh size of the cleaning filter is smaller than an average particle size of the powder release agent, blockage of the filtration unit may always be solved. Accordingly, use of the filter member having a small mesh size enables suction of the powder release agent by the pressure reducing unit to be reduced. In addition, even if the mechanical booster pump is used, the use of the filter member having the small mesh size enables occurrence of failure of the mechanical booster pump to be reduced.

DETAILED DESCRIPTION OF THE PREFERRED EMBODIMENTS

Constitution of Embodiment

Figure 1:
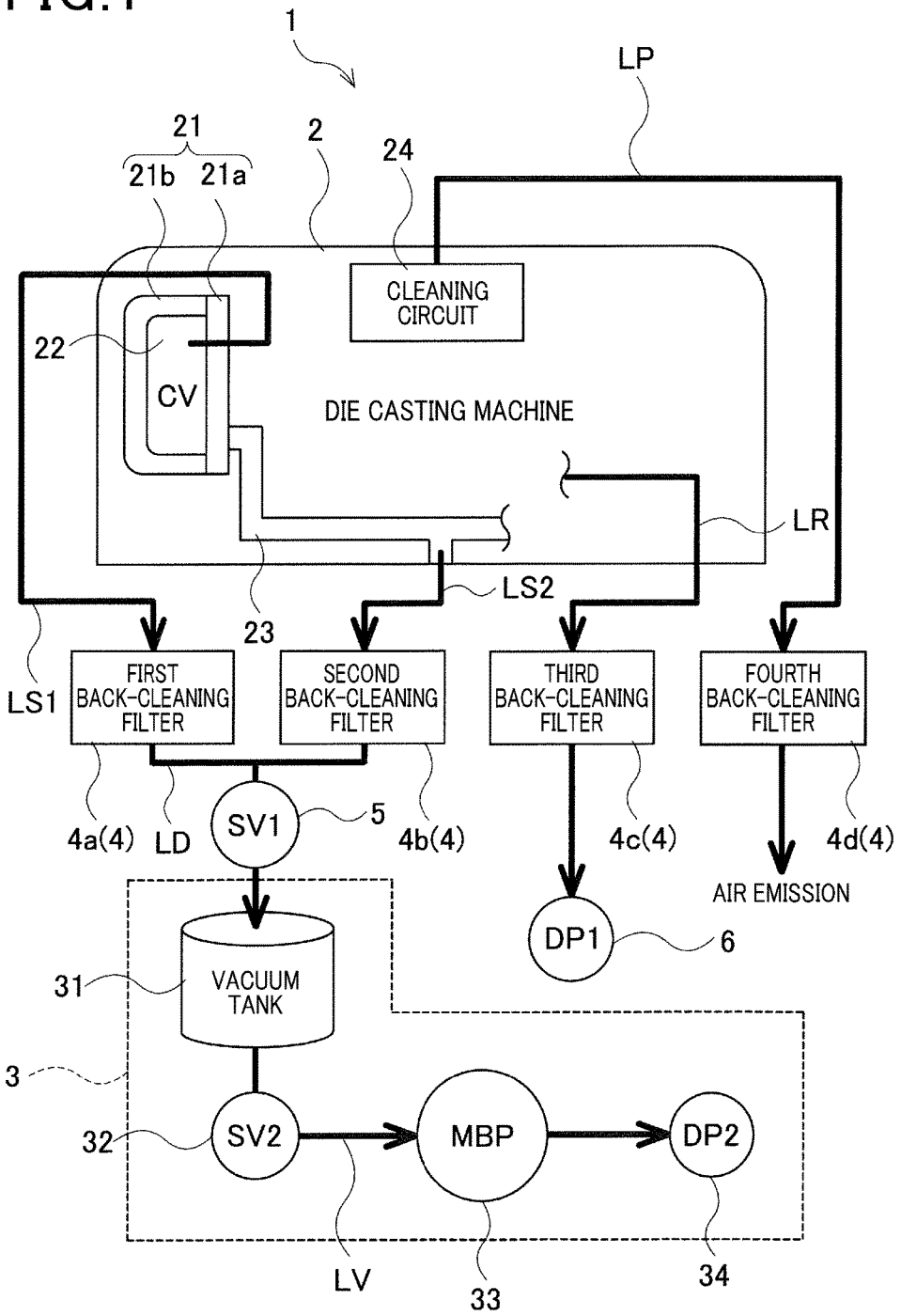
FIG. 1 shows a simplified overall view of a vacuum die casting apparatus according to a first embodiment of the present disclosure.
Figure 2:
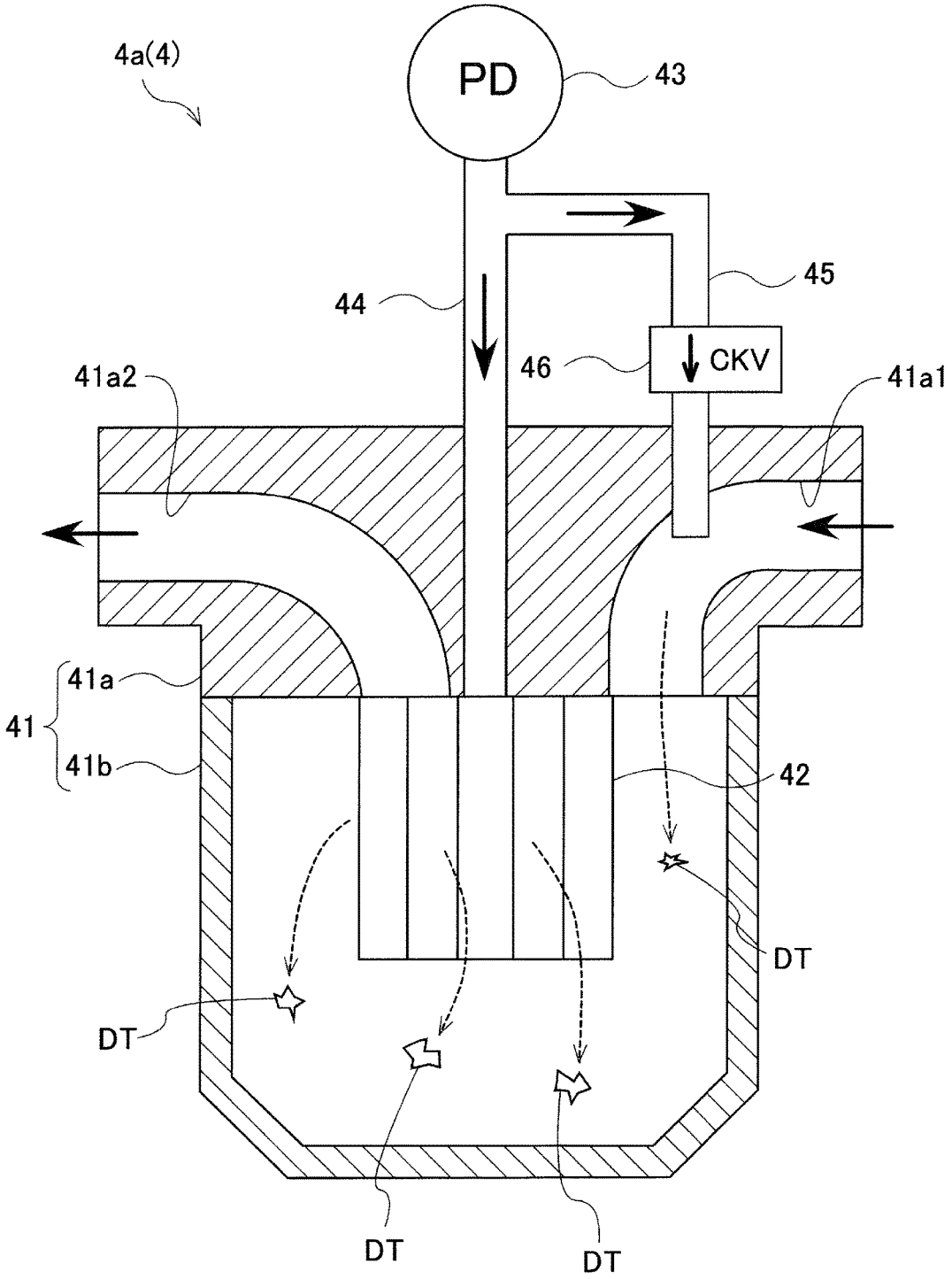
FIG. 2 shows a schematic sectional view of a back-cleaning filter shown in FIG. 1.
Figure 3:
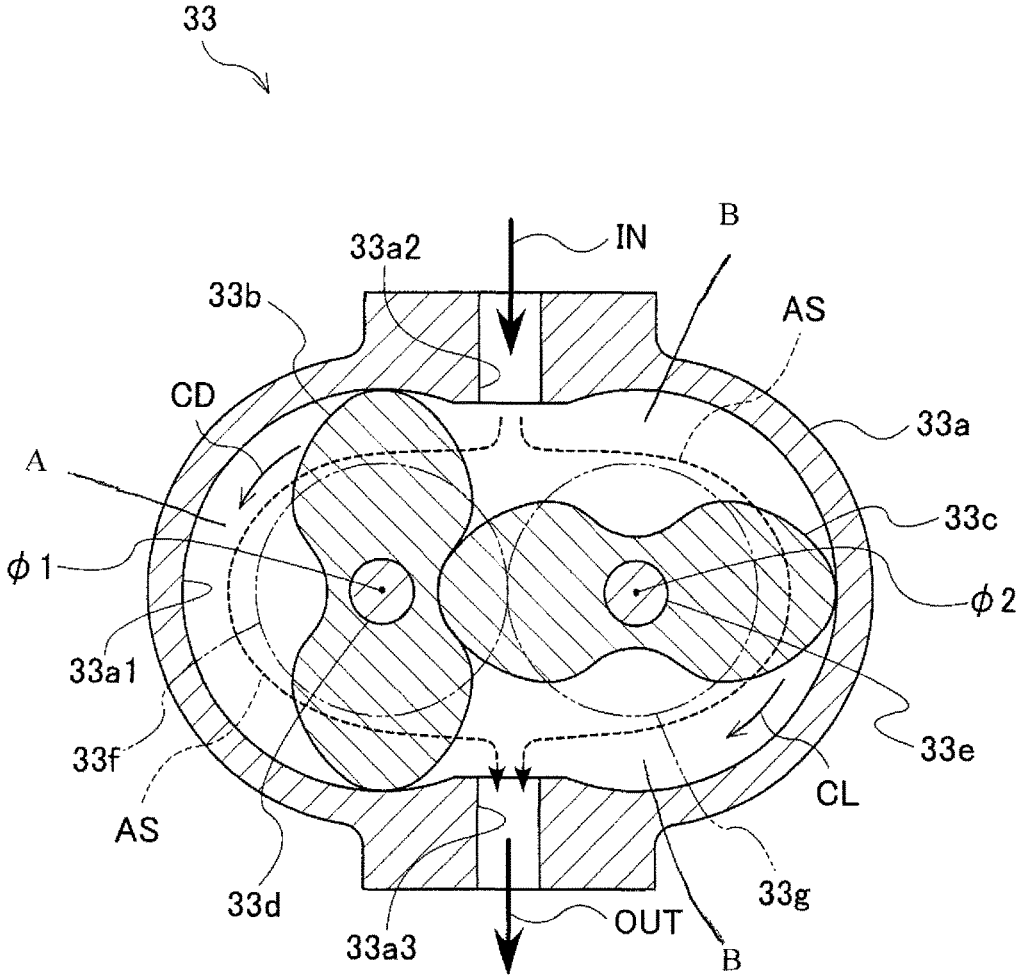
FIG. 3 shows a simplified sectional view of a mechanical booster pump shown in FIG. 1.

A vacuum die casting apparatus 1 according to a first embodiment of the present disclosure using FIG. 1-FIG. 3 is described below. Incidentally, a term "mesh size is small" as used herein means fine-meshed filter member 42.

(Whole Structure of Vacuum Die Casting Apparatus)

As shown in FIG. 1, the vacuum die casting apparatus 1 has a die casting machine 2 performing a die casting. The die casting machine 2 includes a mold 21 which is made up of a fixed mold 21*a* and a movable mold 21*b*. When the fixed mold 21*a* and the movable mold 21*b* are closed, a cavity 22 is formed inside of the mold 21. The cavity 22 is coupled to an injection sleeve 23. A molten metal such as aluminum (Al) is injected under high pressure from an injector (not shown) to the inside of the cavity 22 via the injection sleeve 23.

The cavity 22 and the injection sleeve 23 are coupled to a vacuum unit 3 via a pressure reducing path LD. The vacuum unit 3 is considered as a pressure reducing unit. A first suction path LS1, which forms the pressure reducing path LD, communicates between a cavity 22 and a vacuum tank 31 included in the vacuum unit 3. A first back-cleaning filter 4*a*, which is described below, is formed between the cavity 22 on the first suction path LS1 and the vacuum tank 31.

On the other hand, a second suction path LS2 is included in the pressure reducing path LD and communicates between the injection sleeve 23 and the vacuum tank. A second back-cleaning filter 4*b* is formed between the injection sleeve 23 on the second suction path LS2 and the vacuum tank 31. The first back-cleaning filter 4*a* and the second back-cleaning filter 4*b* have different names from each other for convenience of explanation, however, configurations of these are the same as each other. The first back-cleaning filter 4*a* and the second back-cleaning filter 4*b* are considered as a filtration unit and cleaning filters.

Further, on the pressure reducing path LD, a first solenoid valve 5 is coupled to the first back-cleaning filter 4*a*, the vacuum tank 31 and the second back-cleaning filter 4*b*. The first solenoid valve 5 on the pressure reducing path LD opens and shuts between the die casting machine 2 and the vacuum tank 31.

The cavity of the die casting machine 2 is coupled to a first dry pump via a release agent suction path LR. A third back-cleaning filter 4*c* is formed on the release agent suction path LR. A cleaning circuit 24, which is included in the die casting machine 2, is coupled to a release agent supply path (not shown) of the die casting machine 2. The cleaning circuit 24 is coupled to an air injection path LP. A fourth back-cleaning filter 4*d* is formed on the air injection path LP. The cleaning circuit 24 allows powder release agent, which remained in the release agent supply path, to be released into the atmosphere via the air injection path LP by supplying high pressure air to the release agent supply path.

The above-described third back-cleaning filter 4*c* and the fourth back-cleaning filter 4*d* have the same configuration as the first back-cleaning filter 4*a* and the second back-cleaning filter 4*b*. Hereinafter, "back-cleaning filters 4" is used as for short, for all the first back-cleaning filter 4*a*, the second back-cleaning filter 4*b*, the third back-cleaning filter 4*c* and the fourth back-cleaning filter 4*d*.

In the vacuum unit 3, the vacuum tank 31 is coupled to a vacuum pathway LV. A second solenoid valve 32, mechanical booster pump 33 and a second dry pump 34 are disposed on the vacuum pathway LV in this order from a closer side to the vacuum tank 31. The second solenoid valve 32 on the vacuum pathway LV is opened and is shut between the vacuum tank 31 and the mechanical booster pump 33. The mechanical booster pump 33 is also referred to as a roots pump, details thereof are described later. The second dry pump 34 is considered as a vacuum pump.

In the vacuum unit 3, when the second solenoid valve 32 is opened, gases in the vacuum tank 31 are sucked by the mechanical booster pump 33 and the second dry pump 34. Thereby, a pressure in the vacuum tank 31 is reduced, and a predetermined vacuum degree is kept in the vacuum tank 31.

A through circuit having an overflow valve (not shown) is formed in the mechanical booster pump 33. Therefore, if the mechanical booster pump 33 is damaged, use of only the second dry pump 34 allows the predetermined vacuum degree to be kept in the vacuum tank 31. When the mechanical booster pump 33 and the second dry pump 34 are stopped, the second solenoid valve 32 is shut. Thereby, lowering of the vacuum degree in the vacuum tank 31 and breakdown of the mechanical booster pump 33 by flowback of the gases are prevented.

(Casting Procedure by Vacuum Die Casting Apparatus)

When carrying out the die casting by the vacuum die casting apparatus, first, the fixed mold 21*a* and the movable mold 21*b* are closed. Then, the cavity 22 is formed surrounding the fixed mold 21*a* and the movable mold 21*b*. Next, the first dry pump 6 is driven, and the gases in the cavity 22 are sucked via the release agent suction path LR. After a pressure in the mold 22 is reduced, the powder release agent is injected to an inner periphery of the mold 21. At this time, since the pressure in the mold 21 is reduced, the powder release agent is attached to the inner periphery of the cavity 22. Further, the powder release agent is pressed to the inner periphery of the mold 21 using atmospheric pressure to strengthen the attachment of the powder release agent to the mold 21.

After this, the first solenoid valve 5 is opened, and the gases in the cavity 22 and the injection sleeve 23 are respectively sucked via the first back-cleaning filter 4*a* and the second back-cleaning filter 4*b* by the vacuum tank 31. In this way, after the pressure in the cavity 22 and the injection sleeve 23 are reduced, the molten metal is injected from an injector into the cavity 22. At that time, the cavity 22 and the vacuum unit 3 are uncoupled by a cut-off pin (not shown). After this, when the molten metal in the cavity 22 is semi-coagulated, the mold 21 is opened and a cast product in the mold 21 is released from the mold 21.

(Structure of Back-Cleaning Filter)

A constitution of the first back-cleaning filter 4*a* as a representative of the back-cleaning filter 4, based on FIG. 2, is described below. An upper side of FIG. 2 is defined as an upper side of the first back-cleaning filter 4*a*. A lower side of FIG. 2 is defined as a lower side of the first back-cleaning filter 4*a*. However, these are independent of an actual mounting direction of the first back-cleaning filter 4*a*. The first back-cleaning filter 4*a* is also referred to as a back-cleaning filter or an auto cleaning filter. The first back-cleaning filter 4*a* performs filtration and cleans the filter members without passing gas flow in the vacuum die casting apparatus 1.

As shown in FIG. 2, the first back-cleaning filter 4*a* has an upper case 41*a* and a lower case 41*b* which are fixed to each other. A filter housing 41 is formed by engaging the upper case 41*a* and the lower case 41*b* with each other. An inlet 41*a*1 and an outlet 41*a*2 are disposed in the upper case 41*a*. The inlet 41*a*1 communicates an inside of the filter housing 41 and the cavity 22. The outlet 41*a*2 communicates the inside of the filter housing 41 with the vacuum tank 31.

A cylindrical filter member 42 is disposed in the filter housing 41 such that an extending direction of an axis thereof is a vertical direction. A space, which is surrounded by the lower case 41*b* without the filter member 42, is defined as an outer peripheral space of the filter member 42. The outer peripheral space of the filter member 42 is coupled to the inlet 41*a*1. An inner peripheral space of the filter member 42 is coupled to the outlet 41*a*2.

The first back-cleaning filter 4*a* has a pressure tank (i.e. accumulator) 43 generating a high pressure gas. The pressure tank 43 has a solenoid valve (not shown) and is considered as a pressure feed section. The pressure tank 43 is coupled to the inner peripheral space of the filter member 42 via a first pressure feed path 44. The pressure tank 43 is formed such that the gases therein may be fed to the inner peripheral space of the filter member 42. Further, the pressure tank 43 is coupled to an inner peripheral space of the inlet 41*a*1 via a second pressure feed path 45. A check valve 46 is formed on the second pressure feed path 45. The check valve 46 allows the gas flow from the pressure tank 43 to the inlet 41*a*1 and blocks the gas flow from the inlet 41*a*1 to the pressure tank 43.

At the time of die casting by the vacuum die casting apparatus 1, the gases passed from the cavity 22 to the inlet 41*a*1 pass through the filter member 42 from the inner peripheral space to the outer peripheral space of the filter member 42. Then, powder DT caused by the powder release agent included in the gases falls in the filter housing 41 without passing through the filter member 42. In addition, a part of the powder DT is adhered to an outer peripheral surface of the filter member 42 and clogs the filter member 42. The gases passed through the filter member 42 reach the vacuum pump 31 via the outlet 41*a*2.

When a certain amount or larger of the powder DT clogs the filter member 42, the high pressure gas is fed to the inner peripheral space of the filter member 42 from the pressure tank 43 via the first pressure feed path 44. Thereby, the high pressure gas passes through the filter member 42 from the inner peripheral space to the outer peripheral space of the filter member 42. Therefore, the filter member 42 is cleaned by the high pressure gas and the powder DT clogging the filter member 42 falls in the outer peripheral space of the filter member 42 (shown in FIG. 2). A passing direction of the high pressure gas through the filter member 42 is opposed to a passing direction of the gases sucked from the cavity through the filter member 42.

In addition, when the solenoid valve in the pressure tank 43 is opened, the high pressure gas is also feed from the pressure tank 43 to the inlet 41*a*1 via the second pressure feed path 45. Thereby, the powder DT which remains on an inner wall of the inlet 41*a*1 falls in the filter housing 41. The back-cleaning filter 4 and the other structures are the same constitution mentioned in Japanese Unexamined Patent Application Publication No. 2007-268430. Therefore, further description will be omitted.

(Structure of Mechanical Booster Pump)

Based on FIG. 3, a structure of the mechanical booster pump 33 included in the vacuum unit 3 is simply described. Hereinafter, an upside of FIG. 3 is defined as an upside of the mechanical booster pump 33. A lower side of FIG. 3 is defined as a lower side of the mechanical booster pump 33. However, these are independent of an actual mounting direction of the mechanical booster pump 33.

A pump house 33*a*1 is formed inside of a pump housing 33*a* in the mechanical booster pump 33. The gas flows from the vacuum tank 31 into an inlet port 33*a*2 formed on an upper end portion of the pump housing 33*a* (the gas flow is shown as a bold line arrow "IN" in FIG. 3). The inlet port 33*a*2 is coupled to a pump house 33*a*1. In addition, an exhaust port 33*a*3 is formed on a lower side end portion of the pump housing 33*a*. The exhaust port 33*a*3 allows the gases to be discharged from the pump house 33*a*1 to the second dry pump 34 (the gas flow is shown as a bold line arrow "OUT" in FIG. 3).

A driving side rotor 33*b* and an idler side rotor 33*c*, which each have a cocoon shape, for example as shown in FIG. 3, are disposed in the pump house 33*a*1. The driving side rotor 33*b* is fixed to a driving shaft 33*d*. The driving shaft 33*d* is disposed in the pump housing 33*a* so that the driving shaft 33*d* is able to be rotate around on its own drive axis φ1. An electric motor (not shown) allows the driving shaft 33*d* to be driven. The idler side rotor 33*c* is fixed to an idler shaft 33*e*. The idler shaft 33*e* is disposed in the pump housing 33*a* so that the idler shaft 33*e* is able to be rotated around on its own idler axis φ2.

A driving side gear 33*f* is disposed on one end of the driving shaft 33*d*. An idler side gear 33*g* is disposed on one end of the idler shaft 33*e*. The driving side gear 33*f* is in alignment with the idler side gear 33*g* and they are meshed with each other. A rotation of the driving side gear 33*f* allows the idler side gear 33*g* to be rotated in a direction opposite to a direction in which the driving side gear 33*f* is rotated.

When the driving shaft 33*d* is rotated by the electric motor, the driving side rotor 33*b* is rotated anticlockwise as shown by a solid arrow CD in FIG. 3. A driving power is transmitted from the driving side gear 33*f* to the idler side gear 33*g*, and the idler side rotor 33*c* is rotated as shown by a solid arrow CL in FIG. 3. Therefore, the driving side rotor 33*b* and the idler side rotor 33*c* are rotated in an opposite direction while being meshed with each other in the pump house 33*a*1. An area which is disposed between the pump house 33*a*1 and the driving side rotor 33*b* is defined as an area A. An area which is disposed between the pump house 33*a*1 and the idler side rotor 33*c* is defined as an area B. Rotating the driving side rotor 33*b* and the idler side rotor 33*c* allows the gases sucked into the inlet port 33*a*2 to be temporarily trapped in the area A and the area B. The trapped gases are then transferred to the exhaust port 33*a*3 by rotating the driving side rotor 33*b* and the idler side rotor 33*c*. A gas flow which flows in the pump house 33*a*1 is shown as a dashed arrow AS in FIG. 3.

A roughing pump may be used instead of the mechanical booster pump 33. However, the mechanical booster pump 33 is disposed on an intake side of the second dry pump 34, and an exhaust velocity of the second dry pump 34 in a pressure region where the exhaust velocity falls may be improved. The other configuration of the mechanical booster pump 33 has the same structure as mentioned in Japanese Unexamined Patent Application Publication No. 2015-166583. Therefore, further description will be omitted.

Effects of Embodiment

According to the present embodiment, the vacuum unit 3 includes the mechanical booster pump 33. Thereby, a vacuum degree in the cavity 22 can be increased, which is capable of reducing blowhole, and capable of improving quality of the cast product. In addition, because the vacuum degree in the cavity may reach a target value quickly, productivity for the die casting may be improved. The first back-cleaning filter 4*a*, which cleans the filter member 42, is disposed between the cavity 22 and the vacuum tank 31. Thereby, even if the mesh size of the filter member 42 is smaller than the average particle size of the powder release agent, blockage of the filter member 42 may always be released. Therefore, use of the filter member 42 having the small mesh size enable a suction of the powder release agent by the vacuum unit 3 to be reduced. In addition, even if the mechanical booster pump is used, the use of a filter member having a small mesh size enables occurrence of a failure of the mechanical booster pump to be reduced. Further, a required time for maintenance of the back-cleaning filter 4 is short in comparison with a filter of conventional technology. Therefore, production efficiency for die casting may be increased.

In the vacuum unit 3, the second dry pump 34 is coupled to the vacuum tank 31 via the mechanical booster pump 33 so that the mechanical booster pump 33 and the second dry pump 34 are series-connected. Thereby, when the mechanical booster pump 33 is damaged, the predetermined vacuum degree may be maintained in the vacuum tank 31 using only the second dry pump 34.

Specifically, since the mechanical booster pump 33 has a through circuit, when damaged, the mechanical booster pump 33 may be by-passed and no trouble occurs on actuation of the second dry pump 34.

In addition, the mechanical booster pump 33 and the second dry pump 34 are series-directed. Thereby, increasing a velocity which reaches the predetermined vacuum degree in the cavity 22 and improving the exhaust velocity from the cavity 22 may be compatibly established. Thereby enabling the vacuum die casting apparatus 1 to be well-balanced.

The back-cleaning filter 4 has the second pressure feed path 45 which communicates the pressure tank 43 and an inside of the inlet 41*a*1. Thereby, the gases transferred from the pressure tank 43 to the second pressure feed path 45 enable the powder DT, which remains on the inner wall of the inlet 41*a*1, to fall. Thereby reducing clogging of gas passages in the back-cleaning filter 4 by attaching the powder release agent to the inlet 41*a*1.

The second pressure feed path 45 allows gas flow from the pressure tank 43 to the inlet 41*a*1. The check valve, which blocks gas flow from the inlet 41*a*1 to the pressure tank 43, is formed on the second pressure feed path 45. Thereby, the gases may be transferred from the inlet 41*a*1 to the pressure tank 43. In addition, intrusion of the powder DT into the side of the outlet 41*a*2 from the side of the inlet 41*a*1 via the second pressure feed path 45 without passing through the filter member 42 may be prevented.

Other Embodiment

The prevent embodiment is not intended to be limited the above-described embodiments, but may be modified or extended as follows.

A pump disposed on the exhaust side of the mechanical booster pump 33 may be a diaphragm type vacuum pump, swinging piston type vacuum pump, oil rotary vacuum pump and positive displacement type vacuum pump such as a liquid seal vacuum pump, which can be substituted for the second dry pump 34.

What is claimed is:

1. A vacuum die casting apparatus comprising:

a die casting machine which has a mold including a cavity therein;

a pressure reducing unit which sucks gases from the cavity and which is coupled to the die casting machine via a pressure reducing path; and a filtration unit which is disposed between the die casting machine on the pressure reducing path and the pressure reducing unit, wherein a molten metal is supplied to the cavity in a state that a pressure in the cavity is reduced by the pressure reducing unit, and casting is performed, wherein the filtration unit has a filter housing, a filter member and a cleaning filter, the filter member housed in the filter housing and through which gases sucked from the cavity pass, the cleaning filter cleaning the filter member by feeding the gases to the filter member in a direction which is opposite to a direction through which the gases sucked from the cavity pass, wherein the pressure reducing unit has a mechanical booster pump, wherein the filter housing has an inlet which is coupled to the die casting machine and an outlet which is coupled to the pressure reducing unit, wherein the filter member is cylindrically formed such that an outer and an inner peripheral space thereof are respectively coupled to the inlet and outlet, wherein the cleaning filter has a pressure feed section and a second pressure feed path, the pressure feed section feeding the gases to the inner peripheral space of the filter member via a first pressure feed path, the pressure feed section being coupled to an inside of the inlet via the second pressure feed path.

2. The vacuum die casting apparatus as set forth in claim 1, wherein the pressure reducing unit has a vacuum pump which is coupled to the die casting machine via the mechanical booster pump.

3. The vacuum die casting apparatus as set forth in claim 2, wherein a check valve is formed on the second pressure feed path, the check valve allowing a gas flow from the pressure feed section to the inlet and blocking the gas flow from the inlet to the pressure feed section.

4. The vacuum die casting apparatus as set forth in claim 1, wherein a check valve is formed on the second pressure feed path, the check valve allowing a gas flow from the pressure feed section to the inlet and blocking the gas flow from the inlet to the pressure feed section.

* * * * *